US005174002A

United States Patent [19]

Küsters

[11] Patent Number: 5,174,002

[45] Date of Patent: Dec. 29, 1992

[54] DEFLECTION-CONTROLLED CYLINDER

[75] Inventor: Karl-Heinz Küsters, Krefeld, Fed. Rep. of Germany

[73] Assignee: Eduard Küsters Maschinenfabrik GmbH & Co KG, Krefeld, Fed. Rep. of Germany

[21] Appl. No.: 780,256

[22] Filed: Oct. 21, 1991

[30] Foreign Application Priority Data

Oct. 23, 1990 [DE] Fed. Rep. of Germany ..... 4033638

[51] Int. Cl.[5] ..... B60B 15/16; B21B 13/02

[52] U.S. Cl. ..... 29/115; 29/116.1; 29/116.2

[58] Field of Search ..... 29/116.1, 116.2, 115, 29/113.1, 113.2

[56] References Cited

U.S. PATENT DOCUMENTS

| | | | |
|---|---|---|---|
| 3,766,620 | 10/1973 | Roerig | 29/115 |
| 3,855,681 | 12/1974 | Andriola et al. | 29/115 |
| 4,000,979 | 1/1977 | Biondetti | 29/115 |
| 4,402,233 | 9/1983 | Toivonen et al. | 29/116.1 X |
| 4,676,117 | 6/1987 | Schiel | 29/116.2 X |
| 4,691,421 | 9/1987 | Schiel | 29/116 |
| 4,837,907 | 6/1989 | Roerig et al. | 29/115 |
| 4,962,577 | 10/1990 | Kubik et al. | 29/116.2 |

FOREIGN PATENT DOCUMENTS

| | | |
|---|---|---|
| 2507677 | 10/1978 | Fed. Rep. of Germany . |
| 3623028 | 2/1990 | Fed. Rep. of Germany . |
| 3645034 | 4/1990 | Fed. Rep. of Germany . |

*Primary Examiner*—Timothy V. Eley
*Assistant Examiner*—C. Richard Martin
*Attorney, Agent, or Firm*—Kenyon & Kenyon

[57] ABSTRACT

A driven, deflection-controlled cylinder includes a stationary crosshead that is surrounded by a hollow cylinder. The hollow cylinder has a projection that includes a bushing-like part which encloses the narrow end of the crosshead with a slight radial distance therebetween. A bearing is arranged on the bushing-like part, which is supported in the axially outer part of a bearing bell that is arranged on the outer end of the crosshead. A gear wheel is arranged between the bearing bell and the end of the hollow cylinder, and it engages with a drive pinion in a drive housing. The drive housing is mounted on the side of the projection adjacent to the hollow cylinder, as well as on the outside of the axially outer part of the bearing bell that is opposite the drive pinion.

5 Claims, 1 Drawing Sheet

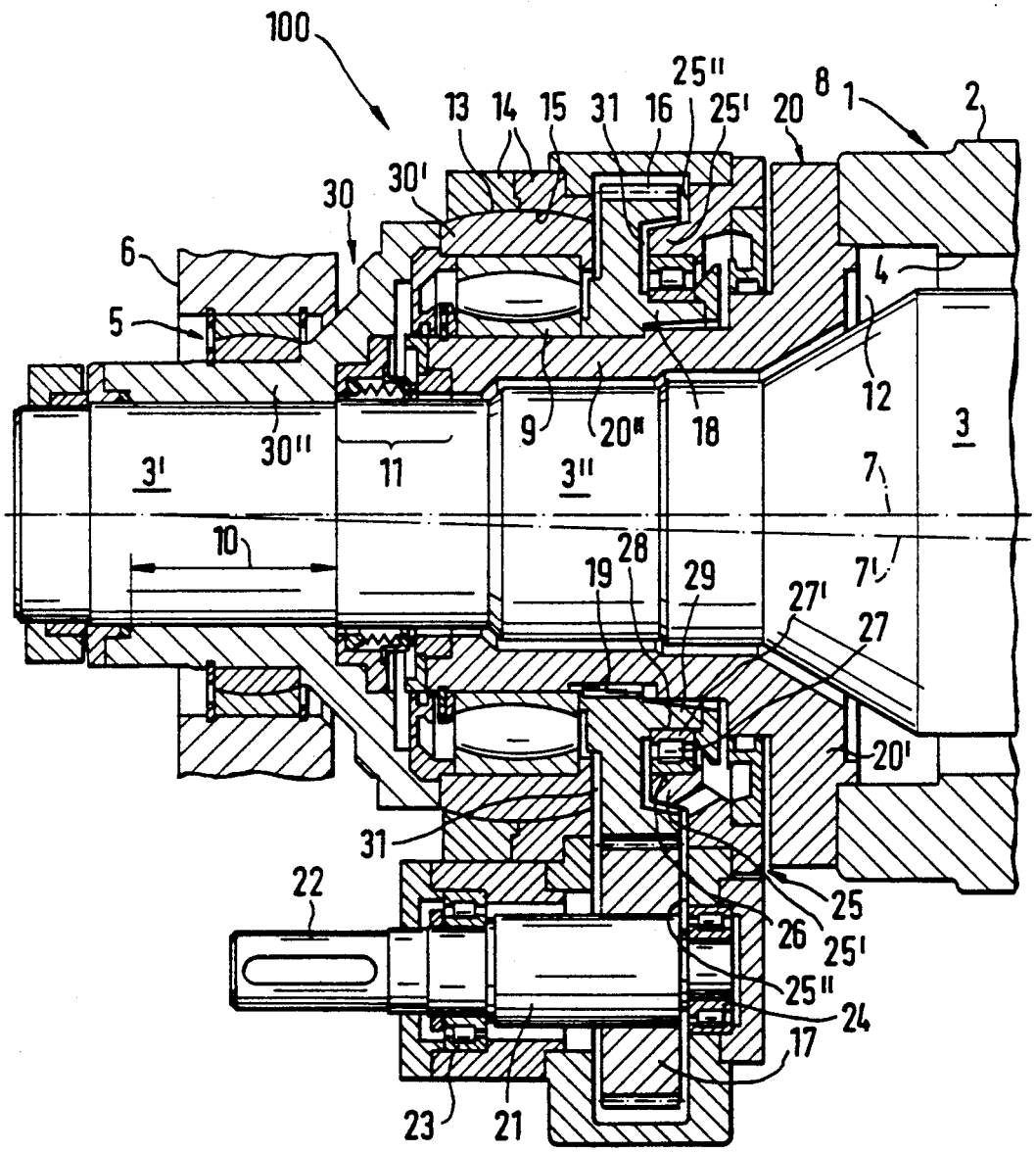
100
25''
8
1
2
13
14
15
31
16
25'
20
30'
30
6
4
5
12
9
20''
18
3
30''
3'
11
3''
7
10
28
19
29
7'
27'
27
20'
31
22
25
26
25'
25''
24
17
23
21

DEFLECTION-CONTROLLED CYLINDER

BACKGROUND OF THE INVENTION

The invention relates generally to cylinders for the pressure and heat treatment of materials, and more particularly to a cylinder having improved deflection control.

Deflection-controlled cylinders are predominantly used for the pressure and temperature treatment of webs of paper, nonwoven material, plastic film and textiles, although they are certainly not limited to these uses. Such cylinders are formed from a stationary crosshead surrounded by a rotatable hollow cylinder that is supported against the crosshead. The crosshead can flex within the hollow cylinder via a suitable hydraulic device. In the case of normal, solid cylinders, the counterforces exerted against the line load caused in the cylinder nip by the line force are created along with a deflection of the cylinder. In deflection-controlled cylinders, this deflection is transferred to the crosshead, so that the hollow cylinder remains independent thereof and can undergo whatever deflection profile is desired. In particular, the hollow cylinder can remain straight.

In a number of applications, it is necessary to drive the hollow cylinder. The drive raises significant design problems, because in certain cases the hollow cylinder can be displaced in the radial direction, and may also demonstrate alignment errors relative to an axis fixed to the housing that result from deflection. Therefore, the working surface of the drive at the hollow cylinder does not have a well-defined position, either with respect to the machine frame or, in particular, with respect to the crosshead, which flexes under stress. It must be noted that the drives, particularly for cylinders in the paper industry which can have a length of up to ten meters and a diameter of up to one meter, must transfer significant power, at equally significant rotational speeds that are on the order of a thousand meters per minute or more. An imprecise gear engagement will take its toll very quickly in the form of excessive wear.

In order to eliminate the effects of the change in position of the ends of the hollow cylinder on the engagement of a drive pinion, it is known to mount the pinion on a coaxial projection of the hollow cylinder in a drive housing. The drive housing and the pinion thus move with the end of the hollow cylinder, but maintain their reciprocal position and their proper engagement.

U.S. Pat. No. 3,766,620 discloses an example of this configuration, in which the end of the hollow cylinder is mounted on the crosshead in a roller bearing and the displacement of the end of the hollow cylinder relative to the crosshead is therefore limited to alignment errors. The gear housing surrounds the projection, which has a smaller outer diameter than the hollow cylinder. An axial flange connected with the gear housing engages with the projection from the radially outward direction. Between the outer diameter of the axial flange and the inner diameter of the projection, a double-roller bearing is arranged, on which the gear housing, which does not rotate, is supported on the rotating projection. Radially outside the projection a drive journal is mounted with its axis parallel to the gear housing, on which a drive pinion is seated. The drive journal engages with a gearing located on the outside of the projection at the level of the inner bearing of the drive housing.

However, the means by which the gear housing is mounted is not very advantageous because the support length is limited to the width of the double-roller bearing, and significant torque is exerted on this bearing due to forces acting when the gear housing is angled relative to the hollow cylinder.

German Pat. Nos. 25 07 677 and 36 23 028 disclose deflection-controlled cylinders in which the hollow cylinders are not mounted on the crosshead at their ends, but rather which can be displaced radially relative to the crosshead, as a whole, along corresponding guides. The overall displacement of the ends of the hollow cylinder with which the drives engage is therefore even greater, because in addition to the purely angular change, there is also a translational displacement. In German Pat. No. 25 07 677, a drive housing with a pinion on both sides thereof is mounted on the outside of a projection of the hollow cylinder. A cylinder of this type, with some design changes, is also disclosed in German Pat. No. 36 23 028, in which the drive journal carrying the pinion is formed as a hollow journal, which has a spiral-toothing gearing on the inside, and into which engages a corresponding spiral-toothed gearing disposed at the end of a drive shaft. In the first two of the above-mentioned references, the displacement of the drive housing was compensated for by a drive via a double-jointed power source. In the last-mentioned reference, the drive shaft with the spiral-toothed gearing performs this task.

The features common to the cylinders mentioned above are that the drive housing is mounted exclusively on the projection of the hollow cylinder, and that the hollow cylinder is guided within bearings or straight guides arranged therein, which engage with the crosshead.

German Pat. No. 36 45 034 discloses a hollow cylinder mounted on the crosshead in which the bearing, in contrast to the cylinder disclosed in U.S. Pat. No. 3,766,620, is seated on the outside of the projection and supported on the inner circumference of a bearing bell, which is arranged without play on a supporting extension at the outer end of the crosshead that has a reduced diameter. This reference indicates that one form of the drive may include a chain gear ring connected to the front side of the hollow cylinder. Such an "open" drive cannot be used in many applications because it is disruptive, simply in terms of design, to the working area of the cylinders located between the machine supports.

SUMMARY OF THE INVENTION

The present invention provides a cylinder that comprising a rotating hollow cylinder having an outer working circumference and an inner circumference. A stationary crosshead extends through the hollow cylinder to form an annular clearance space therebetween. The crosshead has an axially projecting portion that projects axially beyond an axial end of the hollow cylinder and supports the crosshead. The axially projecting portion includes a first portion adjacent to an axial end of the hollow cylinder and an end portion disposed axially beyond the first portion. The end portion has a support portion forming an axial end section of the crosshead. A hydraulic support device is supported on the crosshead inside the hollow cylinder and it acts against the inner circumference of the hollow cylinder. A bearing bell is disposed radially beyond the axial end of the hollow cylinder. The bearing bell includes a first part having an inner diameter and a second part disposed axially beyond and adjacent to the first part that has a smaller inner diameter than the first part. The bearing bell also has an axially extending opening through which the axially projecting portion of the crosshead extends such that the second part of the bearing bell surrounds and supports the end portion of the crosshead without play. The bearing bell is disposed on the support portion of the crosshead and it has an outer circumference for engaging external forces that support the crosshead. An axial projection axially extends from the axial end of the hollow cylinder and includes an axial outermost part having an outer diameter that is less than the outer diameter of the hollow cylinder and axially engages with radial play the axially extending opening of the first part of the bearing bell. A bearing is disposed between the outer surface of the axially outer part of the axial projection and the inner surface of the first part of the bearing bell, and the bearing rotatably supports the hollow cylinder for rotation relative to the bearing bell. An outer gearing is disposed axially between the bearing bell and the hollow cylinder. The gearing is coupled to the axial projection for rotation therewith. A drive pinion engages with the outer gearing and has an axis parallel to the axis of the hollow cylinder. A gear housing has a first side nearest the hollow cylinder and a second side axially beyond the first side in which the drive pinion is mounted and which surrounds the axially outer part of the axial projection. A bearing is disposed on the side of the drive pinion nearest the hollow cylinder which supports the first side of the drive housing on the axial projection. A self-aligning bearing is disposed at an axial position substantially equal to the axial position of a center region of the bearing and is further disposed on the side of the drive pinion opposite the hollow cylinder. The self-aligning bearing supports the second side of the drive housing on an outer surface of the first part of the bearing bell.

The structure of the invention overcomes the difficulty that results from the fact that the outside of the projection on which the gear housing is mounted in the known designs, and with which the pinion engages, is covered by the bearing bell and therefore is no longer accessible from the outside, such as in the embodiment disclosed in German patent 36 45 034. Arranging the entire drive between the bearing bell and the end of the hollow cylinder would be possible, in principle, but would result in an intolerable increase in the required length of the cylinder. Because of the arrangement of the main bearing axially outside the hollow cylinder, the design disclosed in German patent 36 45 034 increases the support length of the crosshead. To limit the deflection (i.e., to maintain the line force that can be transferred) and also purely for space reasons, any further lengthening of the cylinder is prohibited.

The present invention allows the integration of a drive with a drive housing and pinion that requires a minimum of axial space, in which it is essential that the drive housing is supported on the outside of the bearing bell on its side facing the hollow cylinder. Thus, to mount the drive housing at this location, no additional axial space is required. The drive housing is therefore mounted in an optimum manner, that is, it is mounted on both sides of the drive pinion, where room for the bearing facing the adjacent end of the cylinder is preserved for engagement from the outside.

A practical manner in which the outside gearing is made available is by coupling a gear wheel concentrically to the axial projection of the hollow cylinder. By structuring the gear wheel as separate from the projection, which simplifies production, it is possible to use a larger partially circular diameter relative to the outside diameter of the projection, which must be as small as possible because of the bearing.

The bearing of the drive housing, facing the hollow cylinder, can be supported on the separate gear wheel, which facilitates axial removal of the entire drive unit from the projection.

The support of the bearing against the gear wheel can be achieved by providing the gear wheel with an axially projecting projection on a side of the gear wheel facing the axial end of the hollow cylinder, and by arranging the inner ring on the axially projecting projection.

Furthermore, the gear wheel may have an annular groove in its side surface that faces the hollow cylinder. The groove has an edge adjacent to the axis of the hollow cylinder that is formed by the outer surface of the axially projecting projection so that the bearing of the drive housing is disposed at least in part axially within the area of the outer gearing formed by the groove. This configuration provides the most compact axial construction that is possible.

The gearing of the gear wheel must have a certain width in order to avoid excess pressure due to the great forces that must be transferred. A corresponding width (i.e., thickness) is not necessary for the inner gear wheel disk, which only serves to transfer torque. By recessing the gear wheel, the bearing of the gear housing can be more or less inserted into the gear wheel so that length is saved which is equal to at least part of the bearing width.

BRIEF DESCRIPTION OF THE DRAWINGS

The sole drawing Figure shows a longitudinal, cross-sectional view of the drive end of a deflection-controlled cylinder constructed according to the principles of the invention.

DETAILED DESCRIPTION

The cylinder 100 comprises a rotatable hollow cylinder 1 having an outer working cylinder circumference 2 and a cylindrical inner circumference 4. A stationary crosshead 3 extends through the hollow cylinder 1 along its longitudinal axis. An end portion 3' projects axially beyond the hollow cylinder 1 and is mounted in a cylinder support 6 via a self-aligning bearing 5. An annular clearance space is formed between the crosshead 3 and the inner circumference 4 of the hollow cylinder 1. Therefore, the crosshead can flex within the hollow cylinder 1 without contacting the inner circumference 4. If the cylinder nip is located at the top of the drawing, the axis 7 of the crosshead 3 is displaced to approximately the position indicated in the FIG. by line 7', which exaggerates the magnitude of the displacement for the sake of clarity. However, the actual deflection is not insignificant. For very long cylinders, such as those used in the paper industry, the radial deviation at the center of the crosshead 3 may be as large as 30 mm relative to the unstressed position of the crosshead 3.

At the top of the crosshead 3, which faces the cylinder nip located at the top in the drawing, a hydraulic support device (not shown in the Figure), is provided, which can be formed in a number of different ways. For example, the support device may be formed by a series of support pistons that act against the inner circumference 4 of the hollow cylinder 1, or by a hydraulic chamber sealed all around and opened toward the inner circumference 4 of the hollow cylinder 1, or by a bridge piston which that extends along the length of the hollow cylinder 1. The support device makes it possible to exert a hydraulic force against the inner circumference 4 of the hollow cylinder 1. In other words, the support device supports the hollow cylinder 1 from within and exerts a force against the line force in the cylinder nip by abutting the crosshead 3, which bends under the effect of these forces.

An axial projection 20 is directly connected to the end of the hollow cylinder by means of screws 8. In the axially outward direction, the diameter of the crosshead 3 decreases near the end of the hollow cylinder 1. The projection 20 matches this decrease in diameter and accordingly includes a radial part 20' connected to the end of the hollow cylinder 1, as well as a part 20'', which has an outer diameter significantly less than that of the hollow cylinder 1. In the embodiment of the invention shown in the Figure, the outer diameter of part 20'' is approximately half the diameter of the hollow cylinder 1. The part 20'' surrounds the narrower outer part 3'' of the crosshead 3 and is slightly spaced therefrom.

A self-aligning roller bearing 9 is provided on the outer circumference of the bushing-like part 20'' and is disposed near the axially outer end thereof. The roller bearing 9 is supported on its outer side by the inner circumference of a part 30' of a bearing bell 30. The part 30' has a greater diameter than the remainder of the bearing bell 30. Axially beyond the part 30' is a part 30'', which has a smaller diameter than the part 30'. A bearing 5 is disposed on the outer circumference of the part 30''. The inner diameter of part 30'' corresponds to the outer diameter of the projecting end 3' of the crosshead 3 and hence the part 30'' is arranged without play on an axial support portion 10 of the projecting end 3'. Consequently, the line force exerted on the hollow cylinder 1 in the cylinder nip is transferred to the bearing bell 30 via the projection 20 and the bearing 9. The bearing bell 30 provides resistance against the torque of the axial support portion 10 that occurs because of the axial displacement of the bearing 9 relative to the part 30''.

An axial face seal 11 is provided at the axial end of the projection 20, which prevents hydraulic fluid from exiting the annular clearance space 12 between the crosshead 3 and the inner circumference 4 of the hollow cylinder 1 and entering into the area of the bearing 9. The bearing 9 has its own lubrication and hence this lubricant can remain isolated from the hydraulic fluid.

The part 30' is designed as a separate part of the bearing bell 30 and is rigidly connected with the remainder thereof. The part 30' has a bronze bearing and a spherical surface 13 on its radially outer side. The center axis the part 30' is coincident with the axis 7 and, in the axial direction, the center of the part 30' is coincident with the center of the bearing 9. A multiple-component drive housing 25 surrounds the projection 20 (specifically, the part 20'' having a reduced diameter) and includes an axial projection 14 that is divided in a plane perpendicular to the axis 7 and which has an inner circumference that corresponds to the spherical surface 13 and which is mounted thereon.

A gear wheel 18, which has a spur gearing 16, is arranged immediately adjacent to the radially inner end of the part 30' that faces the hollow cylinder 1. The gear wheel is arranged on the part 20'' and is connected with a wedge 19, so as not to rotate. A drive pinion 17 on a drive journal 21 is engaged with the spur gearing 16. The end of the drive pinion 17 can be connected to a drive motor or a gear mechanism, via a double-jointed shaft. The drive journal 21 is mounted in an outer part of the gear housing 25 via bearings 23 and 24 disposed on either side of the drive pinion 17.

The gear housing 25 extends inward on the axial side of the gear wheel 18 opposite the projection 14. The gear housing 25 is disposed axially beyond and adjacent to the part 20' of the projection 20, which extends perpendicularly to the axis 7. The inner wall part 25' of the gear housing 25 has a circular opening 26 in which a roller bearing 27 is arranged. The roller bearing 27 is supported by the radially outer surface 28 of an axial projection 29 of the gear wheel 18 that is adjacent to the part 20''.

The inner part 25' of the wall of the gear housing 25 facing the hollow cylinder 1 and surrounding the opening 26 projects in a generally axially outward direction, in contrast to the part 25'' of the inner edge of the wall of the gear housing 25, which is located radially beyond the inner part 25' and which is oriented perpendicular to the axis of the hollow cylinder 1. The inner part 25' engages with a circumferential, annular groove 31 within the side surface of the gear wheel 18 that faces the hollow cylinder 1. The edge of the groove 31 nearest the axis of the hollow cylinder 1 is formed by the outer surface 28 of the projection 29. Because of this arrangement, the bearing 27 can be moved into the interior part of the gear wheel 18 by a specifiable distance in order to reduce the length of the configuration. The spur gearing 16 is sufficiently wide to partly extend over the bearing 27.

The drive housing 25 is supported on both sides of the drive pinion 17 by a sufficient length. No additional length of the drive housing 25 is required for attaching the bearings that hold the drive housing 25 (on the left side of the cylinder, as see in the drawing) because the projection 14, which is required in any case, is rigidly connected with the drive housing 25 and projects axially over the part 30' of the bearing bell 30 from a point radially beyond the part 30'. The drive housing 25 only requires a small additional length in the axial direction on its side facing the hollow cylinder 1, because the bearing 27 partly sits in the axial expanse of the gear wheel.

The support of the cylinder 100 is "mixed". Specifically, the cylinder 100 is supported on one side by the projection 20 which is connected with the hollow cylinder 1, and on the other side by the bearing bell 30, which is connected with the crosshead 3. The angular displacements of the hollow cylinder 1 and the crosshead 3 are absorbed by the spherical structure of the bearing surface 13 and the bearing surface 15 on the projection 14, which can slide on one another.

What is claimed is:

1. A cylinder comprising:

a rotating hollow cylinder having an outer working circumference and an inner circumference;

a stationary crosshead extending through the hollow cylinder to form an annular clearance space therebetween, said crosshead having an axially projecting portion projecting axially beyond an axial end of the hollow cylinder by which the crosshead is supported, said axially projecting portion including a first portion adjacent to an axial end of the hollow cylinder and an end portion disposed axially beyond the first portion, said end portion having a support portion forming an axial end section of the crosshead;

a hydraulic support device supported on the crosshead inside the hollow cylinder which acts against the inner circumference of the hollow cylinder;

a bearing bell disposed radially beyond the axial end of the hollow cylinder that includes a first part having an inner diameter and a second part disposed axially beyond and adjacent to the first part and having a smaller inner diameter than the first part, said bearing bell having an axially extending opening through which the axially projecting portion of the crosshead extends such that the second part of the bearing bell surrounds and supports the end portion of the crosshead without play and is disposed on the support portion of the crosshead, said bearing bell having an outer circumference for engaging external forces supporting the crosshead;

an axial projection axially extending from the axial end of the hollow cylinder that includes an axial outermost part having an outer diameter that is less than the outer diameter of the hollow cylinder and axially engaging with radial play the axially extending opening of the first part of the bearing bell;

a first bearing disposed radially between an outer surface of the axially outer most part of the axial projection and an inner surface of the first part of the bearing bell, said bearing rotatably supporting the hollow cylinder for rotation relative to the bearing bell;

an outer gearing disposed axially between the bearing bell and the hollow cylinder, said gearing coupled to the axial projection for rotation therewith;

a drive pinion engaging with the outer gearing and having an axis parallel to the axis of the hollow cylinder;

a drive housing having a first side nearest the hollow cylinder and a second side axially beyond the first side in which the drive pinion is mounted which surrounds the axially outer part of the axial projection;

a second bearing disposed on the side of the drive pinion axially nearest the hollow cylinder which supports the first side of the drive housing on the axial projection; and a self-aligning bearing disposed at an axial position substantially equal to the axial position of a center region of the first bearing and disposed on the side of the drive pinion axially remote from the hollow cylinder, said self-aligning bearing supporting the second side of the drive housing on an outer surface of the first part of the bearing bell.

2. The cylinder of claim 1 wherein the outer gearing comprises a gear wheel coupled to the axial projection that is concentric therewith.

3. The cylinder claim 2 wherein the gearing has an inner ring that is supported on the gear wheel.

4. The cylinder of claim 3 wherein the gear wheel has an axially projecting projection on a side of the gear wheel facing the axial end of the hollow cylinder, the inner ring being arranged on said axially projecting projection.

5. The cylinder of claim 4 wherein the gear wheel has an annular groove in the side surface of the gear wheel facing the hollow cylinder, said groove having an edge adjacent to the axis of the hollow cylinder that is formed by the outer surface of the axially projecting projection so that the bearing of the drive housing is disposed at least in part axially within the area of the outer gearing formed by the groove.

* * * * *